US005704814A

United States Patent [19]

McCarthy

[11] Patent Number: 5,704,814

[45] Date of Patent: Jan. 6, 1998

[54] ELECTRICAL CONNECTOR

[75] Inventor: Dale C. McCarthy, Pensacola, Fla.

[73] Assignee: Centerpin Technology, Inc., Gulf Breeze, Fla.

[21] Appl. No.: 645,514

[22] Filed: May 14, 1996

[51] Int. Cl.[6] ..... H01R 13/502

[52] U.S. Cl. ..... 439/695; 439/428

[58] Field of Search ..... 439/427, 428, 439/431, 461, 695

[56] References Cited

U.S. PATENT DOCUMENTS

| | | | |
|---|---|---|---|
| 916,313 | 3/1909 | Herrington | 439/428 |
| 3,097,035 | 7/1963 | Despard | 439/428 X |
| 3,633,147 | 1/1972 | Polidori | 439/428 X |
| 3,860,320 | 1/1975 | Danner . | |
| 4,013,333 | 3/1977 | Chang . | |
| 4,091,233 | 5/1978 | Berman | 174/88 |
| 4,374,458 | 2/1983 | Komada | 439/427 X |
| 4,786,760 | 11/1988 | Friedhelm | 174/84 |
| 5,403,201 | 4/1995 | McCarthy | 439/427 |

*Primary Examiner*—Khiem Nguyen

*Attorney, Agent, or Firm*—William M. Hobby, III

[57] ABSTRACT

An electrical connector for coupling to an insulated electrical conductor includes an insulated housing having a threaded bore therein, which bore has a tapered portion therein. An electrical conductive prong has two end portions with one end portion attached to the housing and having a second end portion protruding axially into the housing bore for receiving the end of an insulated electrical conductor. A threaded compression collar is threadedly attached in the bore and has a bore extending axially therethrough for insertion of a wire therethrough and into the housing bore and onto the pointed prong extending thereinto. The threaded compression collar has a compressed portion compressible by threading the collar into the tapered portion of the bore whereby threading the collar onto the tapered portion of the bore clamps the collar onto the wire placed therein so that an insulated wire can be rapidly connected to an electrical connector without removing the insulation from the end of the wire. The collar has the bores tapered with an expandable and compressible end so that different size wires can be inserted therethrough and guided onto the connector prong. The collar has split end portions to allow expansion or compression and can be a one piece polymer member.

21 Claims, 1 Drawing Sheet

ELECTRICAL CONNECTOR

BACKGROUND OF THE INVENTION

The present invention relates to electrical connectors and especially to an electrical connector for coupling to an insulated electrical conductor without stripping the end of the insulated electrical conductor.

In the past, a wide variety of electrical wire connectors have been provided for connecting to wire ends. In a typical connector, the end of the wire is stripped of insulation and the bare wire is inserted into a connector where it can be soldered or clamped or otherwise attached to the connector. It is also common to tin the wire ends by coating the wire end with solder and a wide variety of connectors have been provided which removably hold the wire to the connector.

Typical connectors are seen in audio systems, such as in hi-fi speakers in which a wire end is stripped of the insulation and is inserted in an opening and a threaded nut is threaded down onto the wire, the nut can be loosened for removing the wire. Other audio speakers include spring clamps which allows a wire end to be stripped of insulation and inserted into an opening while lifting the spring connector clamp and then releasing the spring connector clamp onto the wire. Relifting of the spring connector clamp allows the removal of the wire end. Other commonly used connectors allow a stripped wire end to be inserted into a connector or into both ends of a connector and then clamped with pliers to collapse a conductive sleeve onto the wire. This type of connector can be insulated or not as desired since it is made of a malleable metal in which the collapsing onto the stripped wire end provides the necessary electrical contact.

In contrast to these various types of wire connectors, the present invention deals with a wire connector that does not require the insulation to be stripped and also provides, in some embodiments, for the insertion of the insulated wire end in a manner to lock the wire end in place inside the bore of a wire connector.

Prior wire connectors can be seen in the following U.S. Patents. The Chang patent, U.S. Pat. No. 4,013,333, for a wire connector having two concentric sockets adapted to be assembled one into the other and in which the inner socket has a conductive needle mounted therein for sliding a wire end into each end of the connector and which also uses a spike pressed in two holes in the sleeves to penetrate the coating of the wire ends. In the U.S. patent to Danner, U.S. Pat. No. 3,860,320, a dangler cathode cable assembly is connected to a ball-like cathode member by stripping the end portion of the cable and inserting the end portion into a sleeve which is pressed into an undersized tapered socket and which has a pointed pin therein. In the U.S. patent to Friedhelm, U.S. Pat. No. 4,786,760, a cable connector for piezoelectric cable has an insulated cable end which is inserted into a sleeve. In the U.S. patent to Berman, U.S. Pat. No. 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector. In my prior U.S. Pat. No. 5,403,201 an electrical connector is coupled to an insulated electrical conductor without stripping the end of the insulated conductor. The insulated wire is held with a spring clamp which allows the wire to be released.

The present invention utilizes an electrical connector for coupling to an insulated electrical conductor end which is inserted into a bore through a compression collar in a housing bore to drive a prong into the conductor end and to releasably clamp and hold the insulated wire end within the electrical connector with compression collar.

SUMMARY OF THE INVENTION

An electrical connector for coupling to an insulated electrical conductor includes an insulated housing having a threaded bore therein, which bore has a tapered portion therein. An electrical conductive prong has two end portions with one end portion attached to the housing and having a second end portion protruding axially into the housing bore for receiving the end of an insulated electrical conductor. A threaded compression collar is threadedly attached in the bore and has a bore extending axially therethrough for insertion of a wire therethrough and into the housing bore and onto the pointed prong extending thereinto. The threaded compression collar has a compressed portion compressible by threading the collar into the tapered portion of the bore whereby threading the collar onto the tapered portion of the bore clamps the collar onto the wire placed therein so that an insulated wire can be rapidly connected to an electrical connector without removing the insulation from the end of the wire. The collar has the bores tapered with an expandable and compressible end so that different size wires can be inserted therethrough and guided onto the connector prong. The collar has split end portions to allow expansion or compression and can be a one piece polymer member.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
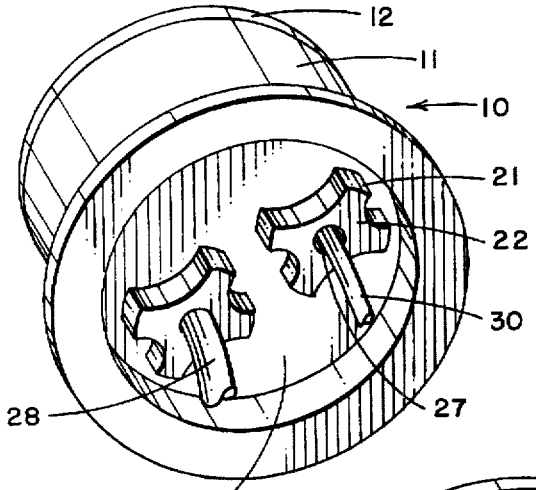
FIG. 1 is a perspective view of an electrical connector in accordance with the present invention.
Figure 2:
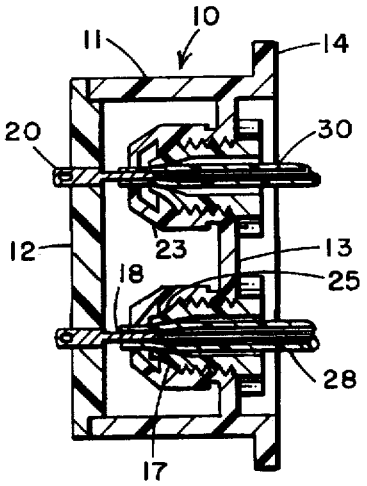
FIG. 2 is a sectional view taken through the electrical connector of FIG. 1.
Figure 3:
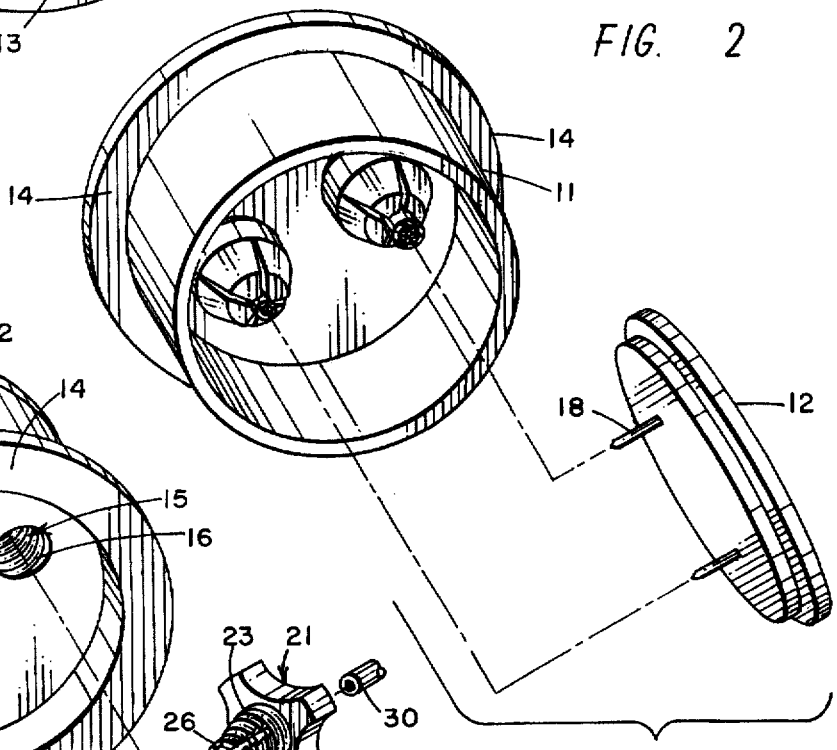
FIG. 3 is an exploded rear perspective view of the electrical connector of FIGS. 1 and 2.

Referring to the drawings and FIGS. 1–4, an electrical connector 10 has a housing 11 having a rear housing portion 12 and a front housing portion 13 having a flange 14 extending therearound. The housing may be made of a polymer or plastic material and the front housing piece 13 has a pair of threaded bores 15 extending therein having threads 16. The bores, as seen in FIG. 2, each have a tapered end portion 17 therein and an electrical connecting center pin or prong 18 extending therein from one end. The prong is attached to the rear cover 12 and has a wire connecting eye 20 extending out of the back 12 of the connector housing. A threaded collar member 21 has a handle 22 and external threads 23 which engage the internal threads 16 of the bores 15.

Figure 4:
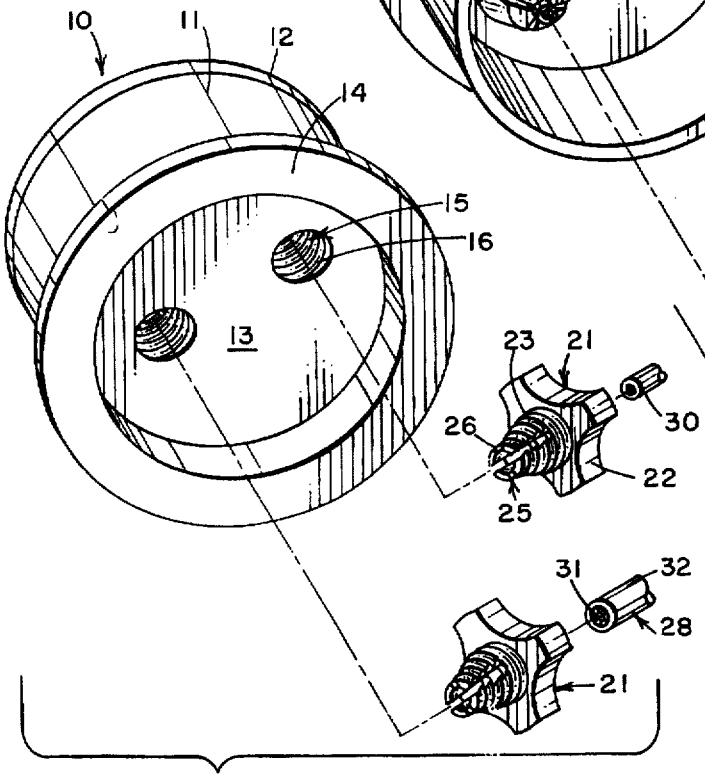
FIG. 4 is an exploded front perspective view of the electrical connector of FIGS. 1–3.

As seen in FIG. 4, each collar 21 has a threaded tapered end 25 having a plurality of slits 26 therein. The collar 21 can be made of a polymer material and has the slits 26 the tapered portion 25 to allow the collar to expand as different size wire is pushed through the collar bore 27 to guide the wire through the center of the collar 21 along the axis thereof. The wire is guided onto the center pin or protruding prong 18 so that the still insulated piece of wire can be inserted thereonto to provide an electrical connection. Once the wire is inserted, the electrical connection is made by sliding the conductor portion of the wire onto the connecting prong 18. The collar 21 handle 22 can be rotated to thread the external threads 23 further into the internal threads 16 so that the end 26 of the collar 21 is compressed by the angled surface 17 of the connector bore 15. As it pushes further in, the annular angled surface 17 compresses the split collar end 26 to clamp down onto the wire member 28 or 30 of FIG. 1 to firmly clamp the wire member into position extending onto the electrical connector.

In operation, a wire of any size, such as wires 28 or 30, can be inserted into the bore 27 until it is pushed onto the center pin 18 in the housing 11. The threaded collar 21 can then be rotated to compress the end 25 into the wedging or narrowing surface 17 to compress onto the wire 28 or 30 to lock the wire to the connector. Thus, a wide variety of wire sizes can be inserted into a universal electrical connector merely by sliding it into the bore 17 which makes the electrical contact without removing the insulation from the wire end and then clamping down upon the wire by rotating the collar handle 22. The wire can be removed simply by loosening the collar 21 by rotating the handle 22 in a counterclockwise direction to thereby loosen the compression of a collar end to allow the wire to be pulled loose.

The present connection is advantageous in situations such as in connecting of audio speakers where different size wires are frequently used including some of the larger cables. Thus, the electrical connector is universal as to a wide variety of wire sizes and allows the rapid connection of merely sliding the wire in and onto the center pin electrical connector conductor and, with a couple of twists of the collar, can threadedly lock clamp the cable onto the connector so that it cannot be easily pulled out without loosening the collar 21. The conductors 31 inside the insulation 32 of the wire 28 is thus guided directly onto the connector pin 18 for a complete electrical connection without removing any of the insulation 32 from the end of the wire 28.

It should be clear at this time that an electrical connector has been provided which advantageously allows a rapid connection of an insulated wire end without stripping the wire or tinning the end of the wire and which leaves a fully insulated connector which can be rapidly attached, released, and replaced and which can be used with a wide variety of wire sizes. It should, however, also be clear that the present invention is not to be limited to the forms shown which are to be considered illustrative rather than restrictive.

I claim:

1. An electrical connector for coupling to an insulated electrical conductor comprising:

an electrically insulated housing having a threaded bore therein, said bore having a tapered portion therein;

at least one electrical conductive pointed prong having two end portions, said pointed prong having one end portion attached to said housing and having a second end portion protruding axially into said housing bore for receiving the end of an insulated electrical conductor;

a threaded collar threadedly attached in said bore, said collar having an opening extending axially therethrough for insertion of a wire therein, and said collar having a compressible portion compressible upon driving said collar into the tapered portion of said bore; and said threaded collar having an expandable and compressible portion which expands upon insertion of a wire and compresses onto an inserted wire when threaded into said housing whereby threading said collar into the tapered portion of said bore clamps said collar onto a wire placed therein, whereby an insulated wire can be rapidly connected to an electrical connector without removing the insulation from the end of the wire.

2. An electrical connector for coupling to an insulated electrical conductor in accordance with claim 1 in which said tapered bore in said threaded collar is sized to accept difference size wires.

3. An electrical connector for coupling to an insulated electrical conductor in accordance with claim 1 in which said threaded collar has a handle thereon for manual threading of said collar into and out of said housing.

4. An electrical connector for coupling to an insulated electrical conductor in accordance with claim 3 in which said threaded collar has a plurality of split portions in the end thereof to form a plurality of segments which expand by the insertion of a wire and compress by the threading of said collar into said housing bore.

5. An electrical connector for coupling to an insulated electrical conductor in accordance with claim 4 in which said threaded collar has a tapered point with a plurality of split portions therein.

6. An electrical connector for coupling to an insulated electrical conductor in accordance with claim 5 in which said threaded collar is a one piece polymer collar.

7. An electrical connector for coupling to an insulated electrical conductor in accordance with claim 1 in which said housing has multiple bores therein for multiple threaded collar.

8. An electrical connector for coupling to an insulated electrical conductor in accordance with claim 7 in which said housing has two bores therein.

9. An electrical connector for coupling to an insulated electrical conductor in accordance with claim 8 in which said housing has a hollow interior and has a back plate attached thereto and said back plate has at least one center prong attached therethrough.

10. An electrical connector for coupling to an insulated electrical conductor in accordance with claim 9 in which said housing has a flanged edge for mounting in a surface.

11. An electrical connector for coupling to an insulated electrical conductor in accordance with claim 10 in which said housing is a generally cylindrical shape.

12. An electrical connector for coupling to an insulated electrical conductor comprising:

an housing having a bore therein, said bore having a tapered portion therein;

at least one electrical conductive center pin attached to said housing and extending into said housing bore for receiving the end of an insulated electrical conductor;

a compression collar sized to fit into said housing bore for attachment therein, said collar having a bore extending therethrough for insertion of a wire therein, and said collar having a compressible portion compressible upon driving said collar into said housing bore thereby driving said collar into said bore clamps said collar onto a wire placed therein; and said collar having an expandable and compressible portion which expands upon insertion of a wire through said collar bore and compresses onto the inserted wire when said collar is driven into said housing, whereby a wire can be rapidly connected to an electrical connector.

13. An electrical connector for coupling to an insulated electrical conductor in accordance with claim 12 in which said collar bore has a tapered bore portion and is sized to accept difference size wires.

14. An electrical connector for coupling to an insulated electrical conductor in accordance with claim 12 in which said collar has a handle thereon.

15. An electrical connector for coupling to an insulated electrical conductor in accordance with claim 12 in which said collar has a plurality of splits in the end thereof to form a plurality of collar segments which expand by the insertion of a wire therethrough and compresses by driving said segments into a housing wedging portion.

16. An electrical connector for coupling to an insulated electrical conductor in accordance with claim 12 in which said collar is tapered with a plurality of splits in the tapered portion.

17. An electrical connector for coupling to an insulated electrical conductor in accordance with claim 14 in which said collar is a one piece polymer collar.

18. An electrical connector for coupling to an insulated electrical conductor in accordance with claim 17 in which said housing has multiple bores therein for multiple collars.

19. An electrical connector for coupling to an insulated electrical conductor in accordance with claim 18 in which said housing has a hollow interior and has a back plate attached thereto and said back plate has at least one center pin attached therethrough.

20. An electrical connector for coupling to an insulated electrical conductor in accordance with claim 19 in which said housing has a flanged edge for mounting in a surface.

21. An electrical connector for coupling to an insulated electrical conductor in accordance with claim 20 in which said housing is generally cylindrical in shape.

* * * * *